United States Patent [19]

Anderson

[11] Patent Number: 4,962,932

[45] Date of Patent: Oct. 16, 1990

[54] GOLF PUTTER HEAD WITH ADJUSTABLE WEIGHT CYLINDER

[76] Inventor: Thomas G. Anderson, 55 S. Judd St. #1608, Honolulu, Hi. 96817

[21] Appl. No.: 404,329

[22] Filed: Sep. 6, 1989

[51] Int. Cl.[5] ..... A63B 53/04

[52] U.S. Cl. ..... 273/171; 273/167 F; 273/80 A

[58] Field of Search ..... 273/171, 167 F, 169, 273/173, 167 B, 164, 80 A, 167 J

[56] References Cited

U.S. PATENT DOCUMENTS

| | | | |
|---|---|---|---|
| 1,343,998 | 6/1920 | Grant | 273/169 |
| 1,840,924 | 1/1932 | Tucker | 273/171 |
| 2,998,254 | 8/1961 | Rains et al. | 273/171 |
| 3,143,349 | 3/1964 | MacIntyre | 273/171 |
| 3,191,936 | 6/1965 | Guier | 273/171 |
| 3,909,005 | 8/1975 | Piszel | 273/171 |
| 3,979,122 | 9/1976 | Belmont | 273/171 |
| 3,979,123 | 9/1976 | Belmont | 273/171 |
| 4,008,896 | 2/1977 | Gordos | 273/171 |
| 4,607,846 | 8/1986 | Perkins | 273/171 |
| 4,828,266 | 5/1989 | Tunstall | 273/171 |
| 4,872,684 | 10/1989 | Dippel | 273/171 X |

FOREIGN PATENT DOCUMENTS

| | | | |
|---|---|---|---|
| 1055984 | 6/1979 | Canada | 273/171 |
| 20747 | of 1910 | United Kingdom | 273/171 |

*Primary Examiner*—William H. Grieb
*Assistant Examiner*—Sebastiano Passaniti
*Attorney, Agent, or Firm*—Martin E. Hasi

[57] ABSTRACT

An improved head for a golf putter having a weight receiving member elevated above the sole of the putter head to raise the vertical center of gravity of the putter head. The weight receiving member has apertures at the toe and heel ends which are adapted to removably retain weights weighing various predetermined amounts, preferably weighted bolts which have slots adapted for operation by a coin.

21 Claims, 2 Drawing Sheets

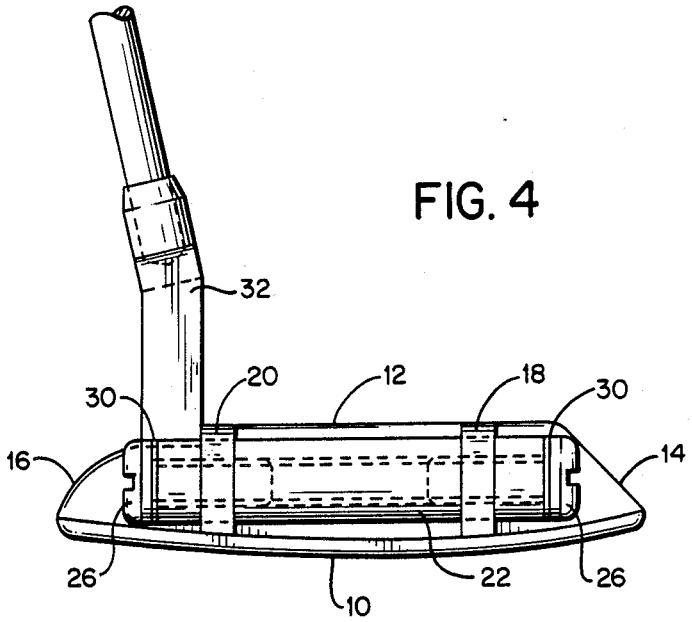
FIG. 4
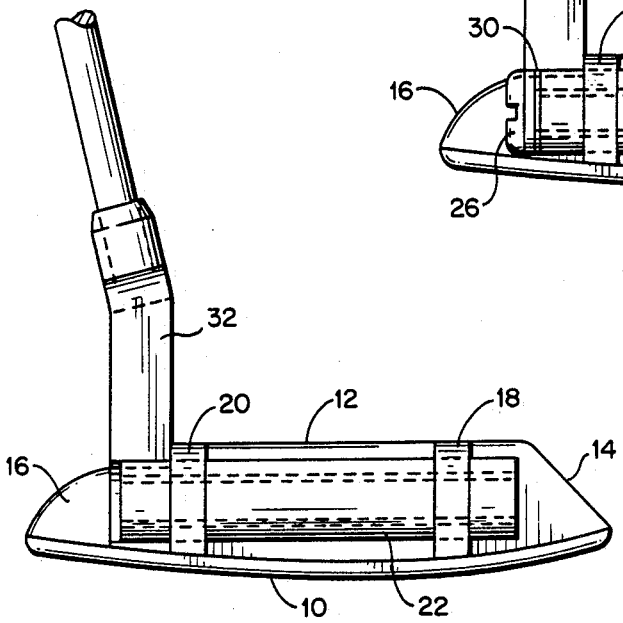
FIG. 5
FIG. 5A
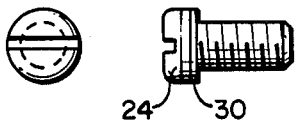
FIG. 5B
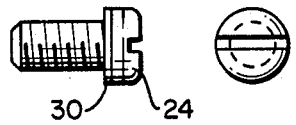
FIG. 5C
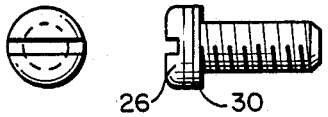
FIG. 5D
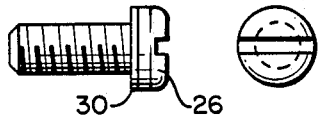
FIG. 5E
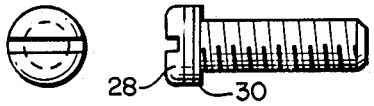
FIG. 5F
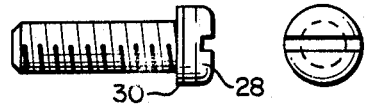

GOLF PUTTER HEAD WITH ADJUSTABLE WEIGHT CYLINDER

BACKGROUND

1. Field of Invention

This invention relates to a golf putter head, specifically to an improved swing weight adjustment system enabling the user to adjust feel and sweet spot of putter.

2. Description of Prior Art

Heretofore, previous golf putters with adjustable weighting systems were difficult and clumsy to adjust. U.S. Pat. No. 3,143,349 to MacIntyre contains a somewhat large number of flat weights that would not be easily added or removed. Therefore the swingweight and feel of the putter would be difficult to change. Another major drawback of this putter is that it does not have the advantage of heel and toe weighting. The weight is basically evenly distributed along the length from heel to toe.

U.S. Pat. No. 3,909,005 to Piszel also is difficult to adjust the weight. This weight adjustment system would not withstand any amount of mistreatment without the weight assemblies comming apart. On the other hand, if the two cup-shaped elements fit snug enough to prevent parting during mistreatment or a rough golf cart ride, it would be difficult to get them apart for weight adjustment purposes. Another disadvantage of this putter is its cylindrical ball striking surface. If the diameter of the cylinder is smaller than that of a golf ball (42.67 mm) the golfer using this putter would have very little vertical margin of error. If the ball was struck too low the ball would have a tendency to hop or leave the surface of the putting green at the moment of impact because it would strike the ball below its equator. If the ball were struck too much above the equator it would tend to drive it downward, therefore; lessening the chance of a neutral spin or overspin that promotes a true, straight rolling putt.

OBJECTS AND ADVANTAGES

Accordingly, several objects and advantages of my invention are:

(a) Simplicity: It's a simple task to add or subtract weight by changing weight bolts. This is done by removing one of the weight bolts in either the heel end or the toe end of the putter head and replacing with either a lighter (shorter) weight bolt or a heavier (longer) weight bolt;

(b) By using heavier weight bolts the swing weight will be increased. The greater mass of the heavier putter head will lessen the chance of leaving the golf ball short of the target. Conversely, if the golfer has a tendency to putt the ball too far past the hole, by using lighter weight bolts, that tendency would be lessened because of less mass striking the golf ball.

(c) By using lighter weight bolt in the heel end of the weight of the weight cylinder and a heavier weight bolt in the toe end the sweet spot is moved slightly toward the toe. The sweet spot is moved toward the heel if the heavier weight bolt is used in the heel and a lighter weight is used in the toe. This adjustability enables the golfer to adjust the horizontal center of gravity toward the heel or toe of the putter head.

The putter head is designed so that the weight cylinder is located up off the bottom or sole. Therefore it's vertical center of gravity is located higher than previous putters. This higher center of gravity increases the chance of topspin at the moment of impact with the ball. Therefore encouraging a straighter, truer rolling putt.

DRAWING FIGURES

FIG. 4 is a rear view of my invention showing the adjustable weight cylinder.

FIG. 5 is another rear view of my invention showing the putter head with the 6 (six) weight adjustment bolts removed. To adjust the weight and sweet spot, any two weight bolts can be threaded into the weight cylinder until the best feel is achieved for any golfer's preference.

Figure 1:
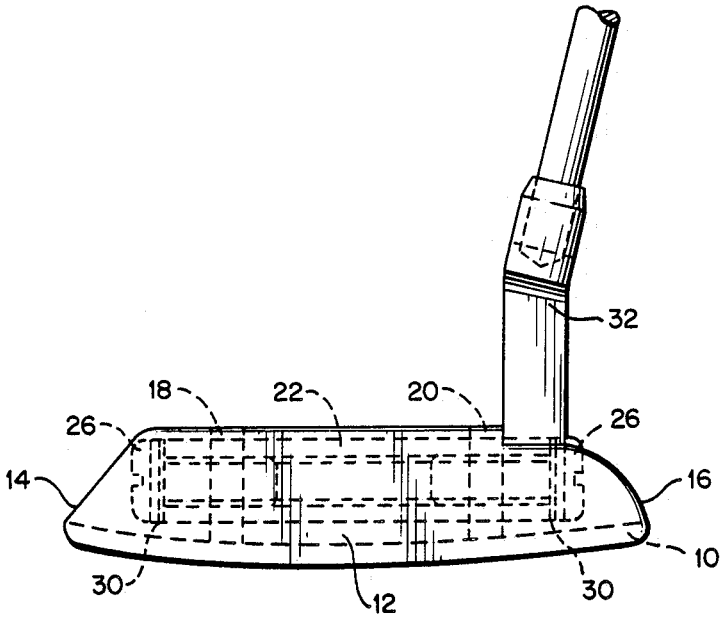
FIG. 1 is a front view of my invention showing the face of putter or the ball striking surface, front edge of base or sole, and the neck that connects the main portion of putter head with the shaft.

FIGS. 5(*a*)–5(*f*) show variously sized weight bolts which may be threadingly engaged within the weight cylinder

REFERENCE NUMERALS IN DRAWINGS

10. sole of putter head
12. face of putter head
14. toe of putter head
16. heel of putter head
18. toe vertical weight cylinder support
20. heel vertical weight cylinder support
22. weight cylinder with internal threads
24. short weight bolts with thread (2)
26. medium weight bolts with threads (2)
28. long weight bolts with threads (2)
30. weight cylinder washers (2)
32. putter head neck

DESCRIPTION—FIGS. 1 and 5

FIG. 1 shows a front view of my golf putter head. The sole 10 is made to rest against the putting surface at it's bottom center and curves upward slightly toward the heel 16 and toe 14 ends. Attached to the front edge of the sole 10 is the face 12 of the putter. The face 12 is a flat surface extending upward from the sole 10 and from heel 16 to toe 14. The neck 32 extends upward from behind the face 12 to a point above the face 12 and turns forward to attach to the portion of the neck 32 containing a cylindrical cavity into which a shaft is inserted.

Figure 2:
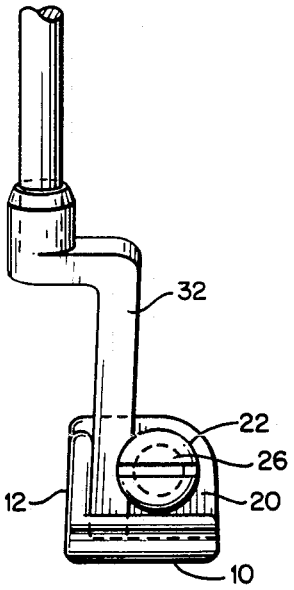
FIG. 2 is an end view of the putter head as viewed from the heel end.

FIG. 2 shows an end view as viewed from the heel 16. End view of weight cylinder 22 and weight bolt 26. Also shown in this view is how the heel vertical weight cylinder support 20 is attached to the back of face 12 and top surface of sole 10. Each vertical weight cylinder support (20 and 18) are designed with a hole into which is fitted the weight cylinder 22. Weight cylinder 22 contains a threaded hole running it's lenth. Different length weight bolts (24, 26, or 28) are threaded into this hole to adjust the swing weight and feel of the putter.

Figure 3:
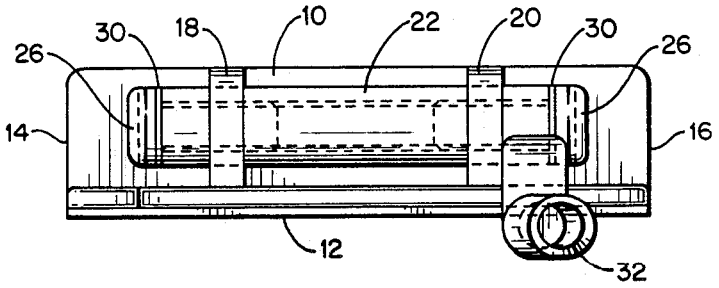
FIG. 3 is a top view of my invention showing the adjustable weight cylinder, the top of the weight cylinder supports that attach said weight cylinder to the sole and face of putter head.

FIG. 3 shows a top view of putter head. Shown in this view are both toe vertical weight cylinder support 18 and heel vertical weight cylinder support 20. This view illustrates plan view of weight cylinder with internal threads 22 and weight bolts 26. Also shown is sole of putter head 10 as it extends rearward from bottom of face 12.

FIG. 4 shows rear view of my invention. Rear edge of sole 10 is illustrated.

FIG. 5 is a rear view of my invention showing all weight bolts 24, 26, and 28 removed from the weight cylinder with internal threads 22. The golfer can choose any combination of weight bolts to get the feel that is best for the conditions of the putting surface he or she intends to putt on.

Operation—FIGS. 2,3,5

The manner of using my golf putter with adjustable weight cylinder is identical to that of other putters in present use except that the sweet spot and the feel are adjustable. A right handed golfer stands so that he or she faces an imaginary line running from the golf ball to the target (golf hole) with target off left shoulder. Using a common putting stroke golfer would strike the golf ball causing it to roll along the imaginary putting line into the golf hole. A left handed golfer would use left handed model and line up with the target off his or her right shoulder. Because putting greens differ from one golf course to another and conditions of putting greens change from day to day, it is to the golfer's advantage to be able to adjust the weight and therefore the feel of the putter to compensate for the different conditions of the putting surface. If the putting surface is "slow" because of water on the grass or not having been mowed recently, the golfer could compensate by inserting the longer and heavier weight bolts 28 into the weight cylinder 22. On the other hand if the putting surface is "fast" because of recent mowing and dry grass, the golfer could choose the shorter and lighter weight bolts 24 to help prevent putting the golf ball too far past the hole. By using a combination of weight bolts 24,26 or 28, the golfer can adjust the "feel" for any putting surface. Another advantage of my invention is if a golfer misses the golf hole consistantly to the right, that tendency can be lessened by a heavier weight bolt 26 or 28 in the heel end 16 of the weight cylinder 22 than the weight bolt in the toe end 14 of the weight cylinder 22. The weight bolts 24, 26, or 28 can be easily changed by simply threading them into or out of the weight cylinder 22. Each weight bolt is designed with a slot in it's head so that it can be loosened or tightened by inserting a small coin into the slot and turning counter clock wise to loosen or clock wise to tighten.

I claim:

1. A head for a golf putter, comprising:

a sole member having a substantially flat sole surface, said sole surface having front edge and a rearward edge defining a sole depth;

an elongated face member with a substantially flat face surface and having a front end and a back end, the distance from said front end to said back end defining a face length, said face surface having a sole edge and an upper edge defining a face height of said face surface, said face member attached at said sole surface to said front edge at substantially right angles;

an elongated weight receiving member having a heel aperture at a heel end a toe at a toe end, and a center of gravity, said apertures extending axially inwardly; and support means attached to said face member on a surface other than said face surface for supporting said weight receiving member substantially parallel to said sole surface and supporting the center of gravity of said weight receiving member above said sole surface by a weight height, approximately centered between said toe and said heel of said face member, wherein said weight height is approximately equal to the radius of a regulation golf ball.

2. A head for a golf putter, according to claim 1, wherein:

said support means comprises first and second support members attached to said face member and to said weight receiving member.

3. A head for a golf putter, according to claim 2, wherein said first support member has a first weight support aperture and said second support member has a second weight support aperture and said weight receiving member passes through and is supported by said weight support apertures.

4. A head for a golf putter, according to claim 1, wherein said support means also is attached to said sole member.

5. A head for a golf putter, according to claim 4, further comprising a neck adapted for receiving a shaft of a golf club, attached to said face member near said heel.

6. A head for a golf putter, according to claim 1, wherein said face height is less than the diameter of a regulation golf ball.

7. A head for a golf putter, according to claim 6, wherein said sole depth is less than the diameter of a regulation golf ball.

8. A head for a golf putter, according to claim 1, further comprising to toe weight removably retained in said toe aperture and a heel weight removably retained in said heel aperture.

9. A head for a golf putter, according to claim 8, wherein said toe weight and said heel weight are selected from a plurality of toe weights and heel weights weighing various predetermined amounts.

10. A head for a golf putter, according to claim 9, wherein said toe aperture and said heel aperture are provided with threads and said toe weights and heel weights comprise weighted bolts adapted for threading into said toe aperture and said heel aperture.

11. A head for a golf putter, according to claim 10, wherein said bolts have slots adapted for insertion of a coin, whereby said bolts can be rotated by inserting a coin in said slots and rotating said coin.

12. A head for a golf putter, according to claim 11, further comprising flexible and compressible washers mounted on said weight bolts.

13. A head for a golf putter, according to claim 2, wherein said weight receiving member comprises a cylinder.

14. A head for a golf putter, according to claim 2, wherein said face member is substantially planar.

15. A head for a golf putter, according to claim 14, wherein said sole member is substantially planar.

16. A head for a golf putter, according to claim 15, wherein said sole surface is slightly convex away from said face.

17. A head for a golf putter, according to claim 1, wherein said face member and said sole member are integrally formed.

18. A head for a golf putter, according to claim 1, wherein said face member, said sole member and said support members comprise metal.

19. A head for a golf putter, according to claim 1, wherein said sole has a length approximately equal to said face length.

20. A head for a golf putter, according to claim 19, wherein said support means positions the center of gravity of said weight receiving member away from said face towards said rearward edge approximately a length equal to the raduis of a regulation golf ball.

21. A head for a golf putter, comprising:

a substantially planar, slightly convex sole having a front edge and a rearward edge defining a sole depth of said sole, said sole depth being approximately equal to the raduis of a regulation a golf ball;

a substantially planar face having a face surface, a sole edge and an upper edge defining a face height of said face surface, a front end and a back end, attached at said sole edge to said front edge at substantially right angles, whereby said face surface and said sole surface define an angle of approximately 87°;

a first weight cylinder support having a first weight support aperture attached to said face adjacent to a toe portion and attached to said sole;

a second weight cylinder support having a second weight support aperture attached to said face adjacent to a heel portion and attached to said sole;

a weight cylinder having a center of gravity and a threaded weight receiving bore with a toe end and a heel end passing through and supported by said weight cylinder supports, whereby the center of gravity of said weight cylinder is supported above said sole approximately a distance equal to the raduis of a regulation golf ball, and is approximately centered between said front end and said back end of said face;

a threaded weighted toe bolt having a slot adapted for insertion of a coin threadingly engaged in said toe end of said weight receiving bore; and a threaded weighted heel bolt having a slot adapted for insertion of a coin threadingly engaged in said heel end of said weight receiving bore;

wherein said toe bolt and said heel bolt are selected from a plurality of toe weights and heel weights weighing various predetermined amounts.

* * * * *